US007461474B1

(12) United States Patent
Lu et al.

(10) Patent No.: US 7,461,474 B1
(45) Date of Patent: Dec. 9, 2008

(54) DISPLAY GRIP FOR SPORTS EQUIPMENT

(75) Inventors: Clive S. Lu, 282 Newbridge Rd., Hicksville, NY (US) 11801; Andy A. Lu, Hicksville, NY (US)

(73) Assignee: Clive S. Lu, Hicksville, NY (US)

( * ) Notice: Subject to any disclaimer, the term of this patent is extended or adjusted under 35 U.S.C. 154(b) by 115 days.

(21) Appl. No.: 11/204,890

(22) Filed: Aug. 16, 2005

Related U.S. Application Data

(63) Continuation-in-part of application No. 10/677,470, filed on Oct. 2, 2003.

(60) Provisional application No. 60/648,144, filed on Jan. 28, 2005.

(51) Int. Cl.
*G09F 3/18* (2006.01)

(52) U.S. Cl. ..... 40/660; 40/661.12

(58) Field of Classification Search ..... 40/661.12; 428/36.91; 81/177.1, 900, DIG. 5; 473/300
See application file for complete search history.

(56) References Cited

U.S. PATENT DOCUMENTS

| | | | | |
|---|---|---|---|---|
| 1,830,102 | A | 11/1931 | Felsenthal | |
| 1,902,438 | A | 3/1933 | Foley | |
| 2,440,664 | A * | 4/1948 | Irons | 156/196 |
| 2,768,457 | A | 10/1956 | Biek | |
| 3,567,237 | A | 3/1971 | Miller, III | |
| 3,606,325 | A * | 9/1971 | Lamkin | 473/298 |
| 3,965,590 | A | 6/1976 | Algaze | |
| 4,195,837 | A | 4/1980 | Poulin | |
| 4,200,676 | A * | 4/1980 | Caponigro et al. | 428/57 |
| 4,355,756 | A * | 10/1982 | Furuya et al. | 229/4.5 |
| 4,600,195 | A | 7/1986 | Hunter | |
| 4,858,925 | A | 8/1989 | DeStefano, Jr. | |
| 4,954,309 | A * | 9/1990 | McGlothlin et al. | 264/307 |
| 5,254,391 | A * | 10/1993 | Davis | 428/195.1 |
| 5,570,541 | A | 11/1996 | Hering | |
| 5,711,720 | A | 1/1998 | Janes et al. | |
| 5,890,308 | A | 4/1999 | Harrington | |
| 6,042,484 | A | 3/2000 | Streit | |
| 6,065,764 | A * | 5/2000 | Moseley | 280/33.992 |
| 6,122,802 | A | 9/2000 | Lo | |
| 6,287,221 | B1 | 9/2001 | Pino | |
| 6,314,598 | B1 | 11/2001 | Yates | |
| 6,718,675 | B1 | 4/2004 | Lu | |
| 6,857,971 | B2 | 2/2005 | Huang | |
| 2001/0039215 | A1 | 11/2001 | Buchanan | |
| 2003/0213155 | A1 | 11/2003 | Kaulbach | |
| 2004/0224786 | A1 * | 11/2004 | Reardon | 473/300 |

FOREIGN PATENT DOCUMENTS

| | | |
|---|---|---|
| DM | 049639 | 8/1999 |

* cited by examiner

*Primary Examiner*—Joanne Silbermann
*Assistant Examiner*—Christopher E Veraa
(74) *Attorney, Agent, or Firm*—King & Schickli, PLLC

(57) ABSTRACT

A method is provided for protecting and displaying a design on sports equipment having a gripping end, comprising overlaying the design and the gripping end with a substantially seamless, substantially transparent top layer. Grips for sporting equipment, manufactured in accordance with the method, are provided also.

13 Claims, 3 Drawing Sheets

DISPLAY GRIP FOR SPORTS EQUIPMENT

This application claims the benefit of U.S. Provisional Application Ser. No. 60/648,144, filed Jan. 28, 2005, and is a continuation-in-part of U.S. patent application Ser. No. 10/677,470, filed Oct. 2, 2003, which claims the benefit of priority in U.S. Pat. No. 6,718,675, filed Jan. 21, 2003. Each of the foregoing documents is incorporated herein in its entirety by reference.

FIELD OF THE INVENTION

This invention relates generally to the field of grips or handles for articles of sporting equipment having a gripping end, such as golf clubs, tennis rackets, and motorcycle and bicycle handlebar grips. In particular, the present invention relates to methods for incorporating a printed media or design element into grips for sporting equipment, and to grips manufactured in accordance with the methods.

BACKGROUND OF THE INVENTION

It is often desirable to display information on sporting equipment. For example, owners often choose to place their name and address on a particular piece of sports equipment as an indicia of ownership, or may wish to decorate the equipment to their liking. Manufacturers often place information regarding the equipment, such as a logo indicating the source of the equipment, or decorative elements, on the grip. For sports equipment having a gripping end, often the most convenient location for displaying such information is the grip. For certain equipment, such as golf clubs or tennis rackets, often the grip or gripping end is the only location on the equipment large enough to allow displaying a significant amount of information. However, this must be done without interfering with or adversely affecting the user's grip. Further, simply placing a means for displaying information such as labels or plaques on the grip of an item of sports equipment exposes the label or plaque to routine wear and tear, such as friction and sweat from the user's hand, soiling, weathering from sun and rain, and the like.

Accordingly, there is a need in the art for a means for displaying desired information or decorative designs on the grip of sports equipment having a shaft for gripping, such as tennis rackets or golf clubs. The means for displaying information should protect the information being displayed from damage and exposure to wear and tear, while not interfering with the primary function of providing a secure gripping area for the user.

SUMMARY OF THE INVENTION

In one aspect, a method is provided for protecting and displaying a design on sports equipment having a gripping end, comprising overlaying the design and the gripping end with a substantially seamless, substantially transparent top layer. The method may include providing at least one base layer overlaying the gripping end, whereby the design and the substantially transparent top layer overlay the at least one base layer. The method may include disposing the design on an underside of the substantially transparent top layer, or alternatively disposing the design on a surface of the base layer opposed to the gripping end. The substantially transparent top layer is a substantially contiguous hollow sleeve. Alternatively, the substantially transparent top layer may be formed by applying a liquid polymer to the gripping end and drying the liquid polymer. The liquid polymer may be applied by dipping, rolling, or spraying.

In another embodiment, the substantially transparent top layer may be a planar sheet having at least a first side and an opposed second side. In this embodiment, the substantially transparent top layer is rendered substantially seamless by overlaying the design and gripping end with the substantially transparent top layer whereby the first side contacts the second side, and fusing at least a portion of the first and second sides together. The sides may be fused by any suitable means, such as by applying a predetermined temperature and pressure. The method may further include the step of fusing at least a portion of the substantially transparent top layer to at least a portion of the at least one base layer and/or to the gripping end to substantially prevent fluid communication between an exterior and an interior of the substantially transparent top layer.

In another aspect, a grip is provided for protecting and displaying a design on sports equipment having a gripping end fabricated as described above, comprising a substantially seamless, substantially transparent top layer overlaying the design and the gripping end. The grip may include at least one base layer disposed on the gripping end, whereby the design and the substantially transparent top layer overlay the at least one base layer. As noted above, the design may be disposed on an underside of the substantially transparent top layer, or may be disposed on a surface of the base layer opposed to the gripping end. The features of the grip are substantially as described above.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification illustrate several aspects of the present invention and, together with the description, serve to explain the principles of the invention. In the drawing.

Reference will now be made in detail to the presently preferred embodiment of the invention, an example of which is illustrated in the accompanying drawings.

DETAILED DESCRIPTION OF THE INVENTION

In accordance with the need identified in the foregoing discussion, the present invention provides methods for protecting and displaying a design on sports equipment having a gripping end, and grips fabricated in accordance with the methods. The invention is intended for use with grips having a substantially transparent top layer provided for displaying the design and protecting it from physical damage, wear and tear, weather, and the like. Example grips adaptable to the invention include, but are not limited to, the inventions described in U.S. Pat. No. 6,718,675 and U.S. patent application Ser. Nos. 10/677,470 and 10/752,077, the disclosure of each of which is incorporated in its entirety herein by reference.

Figure 1:
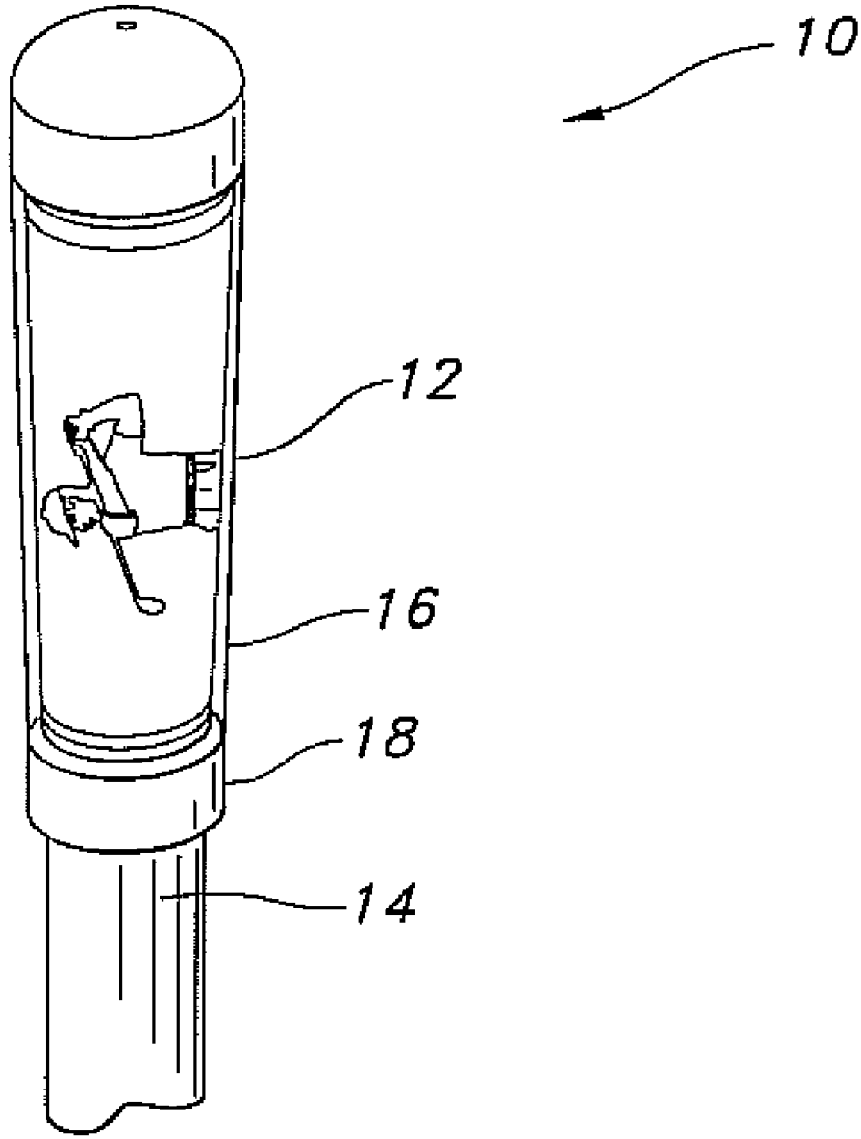
FIG. 1 shows one embodiment of the grip of the present invention, with a design disposed on the base layer.

In one aspect, the present invention provides a method for protecting and displaying a design 12 on sports equipment having a gripping end 14. Referring to FIG. 1, a grip 10 fabricated in accordance with the method is shown, wherein the design 12 and the gripping end 14 are overlayed with a substantially seamless, substantially transparent top layer 16. Examples of such sporting equipment may include, but are not limited to, tennis rackets, golf clubs, motorcycle handlebar grips, bicycle handlebar grips, and the like. Of course, the design 12 may comprise any desired information or shape, such as a corporate logo, an individuals name and/or address, and the like.

Figure 2:
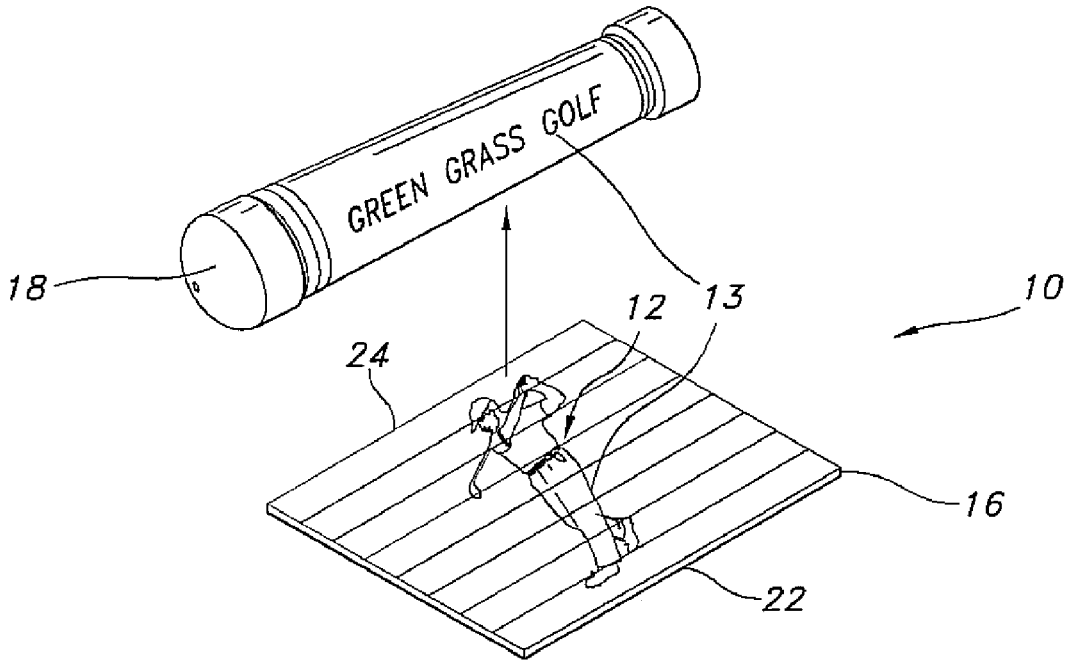
FIG. 2 shows a second embodiment of the grip, having a planar, substantially transparent top layer having a design disposed on an underside thereof.

As is known in this art, at least one base layer 18 may be provided overlaying the gripping end, with the design 12 and the substantially transparent top layer 16 overlaying the base layer 18. The base layer 18 and/or the top layer 16 may be of a composition and of a suitable thickness to provide a padded effect to improve user comfort, and to result in a grip 10 having a predetermined size in accordance with the hand size of the user. Advantageously, by selecting particular materials and thicknesses thereof in fabricating the grip of the invention, it is possible to achieve a lighter weight grip without sacrificing thickness, strength, and cushioning properties of the grip. As described in greater detail in U.S. application Ser. No. 10/677,470, the design 12 may be disposed on an underside of the substantially transparent top layer 16 (FIG. 2), or may be disposed on the surface of the base layer 18 opposite to the gripping end 14 (FIG. 1).

The layers of the grip 10 of the present invention may be fabricated of any suitable material known in the art for use on sporting equipment grips, including but not limited to plastics, polymers such as polyurethane, polyethylene, polypropylene, or polystyrene, rubber and rubber-like materials, latex, and the like, or blends or mixtures thereof. Any suitable adhesive as is known in the sporting equipment art may be used to secure the base layer 18 to the gripping end 14 and to secure the top layer 16 over the base layer 18.

Figure 3A:
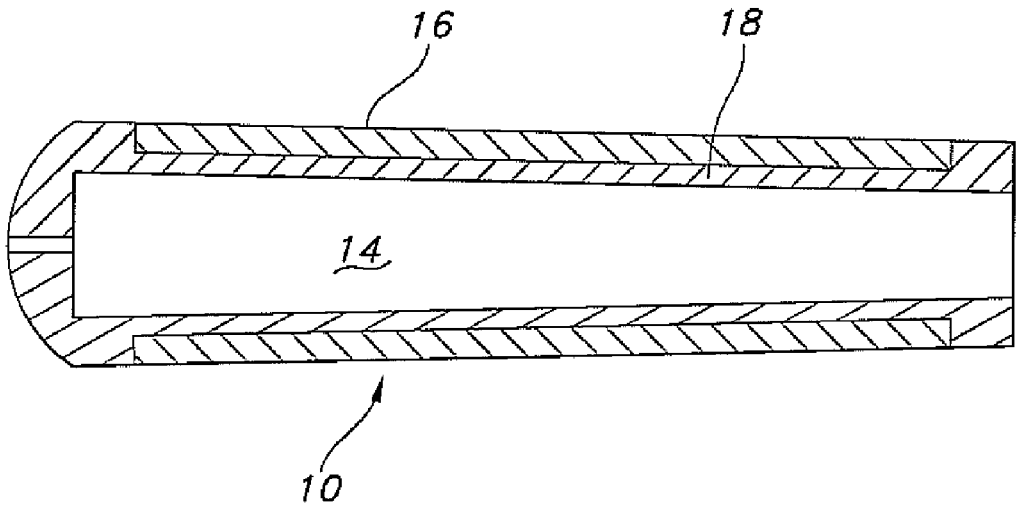
FIG. 3 shows an embodiment of the method of forming a substantially seamless, substantially transparent top layer of the grip of the present invention, showing the planar top layer of FIG. 2 overlaying the base layer (FIG. 3*a*) and the sides of the top layer fused (FIG. 3*b*).
Figure 3B:
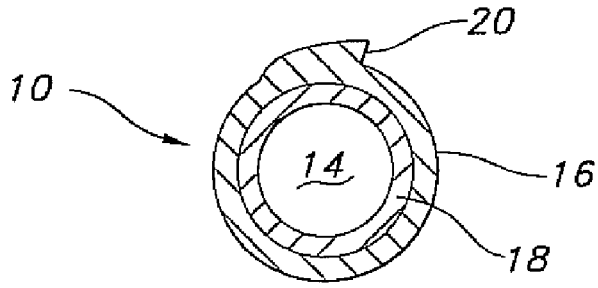

It will be appreciated that the term substantially seamless is intended to mean that at least a portion of the substantially transparent top layer 16 is an uninterrupted layer, even if a discernible seam or gap 20 extends through a partial thickness of the top layer 16 (see FIG. 3*b*). In one embodiment (FIG. 1), the substantially transparent top layer 16 may be a substantially contiguous hollow sleeve. In another embodiment, the substantially transparent top layer 16 may be applied to the gripping end 14 and/or the base layer 18 by applying a suitable substantially transparent liquid polymer solution, such as by spraying, rolling, or dipping, and drying the liquid polymer. As will be appreciated by the skilled artisan, suitable polymers include, but are not limited to, transparent polyethylene, transparent polypropylene, transparent polyurethane, or blends or mixtures thereof. As will also be appreciated by those of skill in this art, suitable adhesives may be added to the substantially transparent liquid polymer, to improve viscosity of the liquid being applied and also tackiness of the finished grip 10.

In another embodiment (FIG. 2), the substantially transparent top layer 16 may be a planar sheet which overlays the gripping end 14 and/or the base layer 18. In this embodiment, the substantially transparent top layer 16 is rendered substantially seamless by overlaying the gripping end 14 and/or the base layer 18 (see FIG. 3*a*) whereby a first side 22 and the opposed second side 24 of the top layer 16 are in contact, and fusing at least a portion of the first and second sides 22, 24 together to form a substantially contiguous layer (FIG. 3*b*). At least a portion of the substantially transparent top layer 16 may also be fused to the base layer 16 and/or the gripping end 14, thereby forming a seal whereby fluid communication between the exterior of the top layer 16 and the interior of the top layer 16 is prevented. It will be appreciated that the term "fused" means joined, blended, or coalesced to form a single entity by any suitable means.

Suitable methods for accomplishing this fusing process are well known in the art. For example, the substantially transparent top layer 16 may be fused by application of heat and pressure. The skilled artisan will appreciate that the proper conditions of heat and pressure will vary in accordance with the polymer(s) selected for the top layer 16. Proper conditions of heat and pressure may vary, respectively, from about 33 to about 212° F., and from about 0.0001 to about 999 psi. It is also known to use a process of ultrasonic fusion or welding to join polymers or other thermoplastic materials, wherein use is made of high frequency sound energy (usually at a frequency of from about 20 to about 40 kHz) to fuse a polymer under pressure.

Other means for fusing the substantially transparent top layer 16 to render it substantially seamless are contemplated by the present invention. For example, it is known to use an electrofusion process wherein thermoplastic elements are joined by use of an electrical heating element. It is also known to utilize graft polymers, such as for example polyester/styrene/acrylic graft polymer RN-230, to graft polymers to one another or to graft monomers to polymers, using proper conditions of temperature but in the absence of adhesives.

Other suitable techniques include selection of compounds for the top layer 16 and/or for the base layer 18 which, by use of the proper solvent, will chemically fuse the polymers. The selection of such compounds is known in the art, and can be derived without undue experimentation by the skilled artisan. Specifically, solvents are selected in view of the composition of the selected polymers which soften and partially solubilize the surface layer of the polymer to allow actual chemical interactions between, for example, the first and second edges 22, 24 of the top layer 16 to fuse at least a portion of the top layer 16. As an example, a complete listing of suitable solvents for particular polymers may be found in Bloch D. R. (1999) "Solvents and Non-Solvents for Polymers," Polymer Handbook, 4$^{th}$ Ed. (Brandrup, Immergut, and Grulke, Eds.), New York, Wiley (incorporated herein in its entirety by reference). It will be appreciated that the selection of suitable solvents in accordance with the polymers selected for the various layers of the grip 10 will be guided by the physical and chemical nature of the polymer(s) to be fused. The end result of selecting the solvent in view of the matrix to be coated is that the solvent softens and partially solubilizes the grip 10 layer, allowing an actual chemical interaction. The important point is that the method selected results in at least partial fusion of the material of the grip 10 layer, such that substantially a single layer results. As is known in the art, a suitable adhesive may be included with the solvent to further improve the fusion process.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, in one embodiment the base layer 18 may be fabricated of a substantially transparent material, similar to the substantially transparent top layer 16 as described herein. The design 12 may be disposed on the base layer 18 by any desired means, such as for example by applying pigment to a top of base layer 18 (or to an underside of top layer 16) to create the desired design 12.

In yet another embodiment, a base layer 18 may be provided, overlaying the gripping end 14 as previously described. The base layer 18 may be fabricated of any suitable material as previously described, including a substantially transparent material. The surface of the base layer 18 may be provided with one or more grooves, channels, or ridges 13 defining the desired design 12. A pigment may be applied to the grooves, channels, or ridges 13 in base layer 18 to render the design 12 more visible. In still yet another embodiment, substantially transparent top layer 16 may include one or more grooves, channels, or ridges 13 defining the design 12 on an underside of top layer 16. As described above, a pigment may be applied to render the design 12 more visible. The grooves or channels 13 may be placed in the base layer 18 or top layer 16 by any suitable method, such as molding, embossing, carving, and the like.

The embodiment described was chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A method for protecting and displaying a design on sports equipment having a gripping end, comprising overlaying the design and substantially an entirety of an exterior periphery of the gripping end with a substantially seamless, substantially transparent top layer, wherein the substantially transparent top layer is rendered seamless after the step of overlaying on the design and the gripping end; and providing at least one cushioning base layer overlaying the gripping end, wherein the design and the substantially transparent top layer overlay the at least one base layer;

wherein the substantially transparent top layer is rendered substantially seamless by overlaying the design and gripping end with the substantially transparent planar sheet whereby a first side thereof contacts an opposed second side thereof, and fusing at least a portion of the first side and the second side together.

2. The method of claim 1, including disposing the design on an underside of the substantially transparent top layer.

3. The method of claim 2, wherein the design is disposed on an underside of the substantially transparent top layer by the step of defining at least one groove, channel, or ridge on said underside.

4. The method of claim 3, further including the step of applying at least one pigment to the at least one groove, channel, or ridge.

5. The method of claim 1, including disposing the design on a surface of the base layer opposed to the gripping end.

6. The method of claim 5, wherein the design is disposed on a surface of the base layer opposed to the gripping end by the step of defining at least one groove, channel, or ridge on said surface.

7. The method of claim 6, further including the step of applying at least one pigment to the at least one groove, channel, or ridge.

8. The method of claim 1, wherein the sides are fused by applying a predetermined temperature and pressure.

9. The method of claim 1, further including the step of fusing at least a portion of the substantially transparent top layer to at least a portion of the at least one base layer and/or to the gripping end to substantially prevent fluid communication between an exterior and an interior of the substantially transparent top layer.

10. A grip for protecting and displaying a design on sports equipment having a gripping end, comprising a substantially seamless, substantially transparent top layer overlaying a design and the gripping end, said design comprising at least one groove, channel, or ridge disposed on an underside of the substantially transparent top layer, wherein the substantially transparent top layer is rendered seamless after the step of overlaying on the design and the gripping end, and further wherein at least a portion of the substantially transparent top layer is fused to at least a portion of the at least one base layer and/or to the gripping end to substantially prevent fluid communication between an exterior and an interior of the substantially transparent top layer.

11. The grip of claim 10, further including at least one base layer disposed on the gripping end, whereby the design and the substantially transparent top layer overlay the at least one base layer.

12. The grip of claim 10, wherein the substantially transparent top layer is a planar sheet having at least a first side and an opposed second side.

13. The grip of claim 10, wherein the design includes at least one pigment applied to the at least one groove, channel, or ridge.

* * * * *